US010533802B2

(12) United States Patent
MacRae

(10) Patent No.: US 10,533,802 B2
(45) Date of Patent: Jan. 14, 2020

(54) FURNACE BRICKS, COOLERS, AND SHELLS/BINDINGS OPERATING IN SYSTEMIC BALANCE

(71) Applicant: MacRae Technologies, Inc., Hayward, CA (US)

(72) Inventor: Allan J. MacRae, Hayward, CA (US)

(73) Assignee: MacRae Technologies, Inc., Hayward, CA (US)

( * ) Notice: Subject to any disclaimer, the term of this patent is extended or adjusted under 35 U.S.C. 154(b) by 0 days.

(21) Appl. No.: 16/443,474

(22) Filed: Jun. 17, 2019

(65) Prior Publication Data

US 2019/0310018 A1 Oct. 10, 2019

Related U.S. Application Data

(63) Continuation-in-part of application No. 16/290,922, filed on Mar. 3, 2019, which is a continuation-in-part
(Continued)

(51) Int. Cl.
*F27D 1/04* (2006.01)
*C21B 7/06* (2006.01)
(Continued)

(52) U.S. Cl.
CPC ..... *F27D 1/04* (2013.01); *C21B 7/06* (2013.01); *F27D 1/004* (2013.01); *F27D 1/148* (2013.01)

(58) Field of Classification Search
CPC ..... F27D 1/12; F27D 1/16; F27D 1/004
(Continued)

(56) References Cited

U.S. PATENT DOCUMENTS 1,021,851 A * 4/1912 Strale ..... F27D 1/04 266/283
1,921,843 A 8/1933 Schruefer
(Continued)

FOREIGN PATENT DOCUMENTS

WO 2011005997 1/2011

OTHER PUBLICATIONS

Computational Modeling of Blast Furnace Stave Cooler Based on Steady State Heat Transfer Analysis, T.R.Mohanty, et al., Intercontinental Conference on Computational Heat and Mass Transfer—2015, Procedia Engineering 127 (2015) 940-946.
(Continued)

*Primary Examiner* — Scott R Kastler
(74) *Attorney, Agent, or Firm* — Main Law Cafe

(57) ABSTRACT

Many substantially identical refractory bricks are assembled into completed horizontal ring rows neatly nested into laterally curved copper stave coolers surrounding the ring. Each brick "locks" into horizontal channels between pairs of parallel horizontal protruding ribs on the hot faces of the stave coolers. Every stave cooler is provisioned with a full covering of the refractory bricks after the stave cooler is mounted inside a corresponding steel containment shell. None of the refractory bricks are permitted to be finished bridging between adjacent stave coolers in the same horizontal row. Each brick is installed in their respective stave coolers with crushable or deformable mortar filling the channels. Each brick hooks a "toe" just under and into an upper of the pair of horizontal ribs, and then rotates in down with favorably oriented and directed earth's gravity to stay in place at least until a next upper row of bricks in a superior horizontal ring "lock" them in a second way.

8 Claims, 12 Drawing Sheets triple-lock brick

Related U.S. Application Data of application No. 13/148,003, filed as application No. PCT/US2011/030611 on Dec. 23, 2011, now Pat. No. 10,247,477, which is a continuation-in-part of application No. PCT/US2010/041414, filed on Jul. 8, 2010.

(60) Provisional application No. 61/223,745, filed on Jul. 8, 2009, provisional application No. 61/231,477, filed on Aug. 5, 2009, provisional application No. 61/319,089, filed on Mar. 30, 2010.

(51) Int. Cl.
*F27D 1/14* (2006.01)
*F27D 1/00* (2006.01)

(58) Field of Classification Search
USPC ..... 266/283
See application file for complete search history.

(56) References Cited

U.S. PATENT DOCUMENTS

| | | | | |
|---|---|---|---|---|
| 1,944,569 | A | | 1/1934 | Nygaard |
| 1,967,281 | A | | 7/1934 | Bigelow |
| 2,319,065 | A | | 5/1943 | Karmanocky |
| 2,475,102 | A | | 7/1949 | Longacre |
| 4,768,447 | A | | 9/1988 | Roumeguere |
| 4,809,621 | A | | 3/1989 | Materna |
| 5,117,604 | A | | 6/1992 | Bly et al. |
| 5,316,268 | A | * | 5/1994 | Mantey ..... C21C 5/44 266/44 |
| 9,102,990 | B2 | | 8/2015 | Smith |
| 2009/0126306 | A1 | | 5/2009 | Jonville et al. |
| 2012/0104670 | A1 | | 5/2012 | Smith |
| 2013/0008636 | A1 | | 1/2013 | Smith |
| 2015/0377554 | A1 | | 12/2015 | Smith |
| 2018/0149429 | A1 | | 5/2018 | Smith et al. |
| 2019/0154338 | A1 | | 5/2019 | Smith |

OTHER PUBLICATIONS

METEC2011 New Method of Lining a Blast Furnace Bosh and Stack, METEC International Steel Conference (InSteelCon) 2011, Dusseldorf, Germany, Jun. 28 to Jul. 2, 2011, Todd G. Smith and Allan J. MacRae.

Computational Modeling of Blast Furnace Cooling Stave Based on Heat Transfer Analysis, Anil Kumar, Shiv Nandan Bansal, Rituraj Chandraker, Materials Physics and Mechanics 15 (2012) 46-65, Jul. 8, 2012.

* cited by examiner 300
302
314
314
314
314
316
316
316
316
316
316
cast iron
stave coolers 314
cast copper
stave coolers 316
various water
flows at different
levels
refractory brick
lining (typ)
stack 304
belly 306
Bosch 308
tuyere level 310
hearth 312
blast furnace

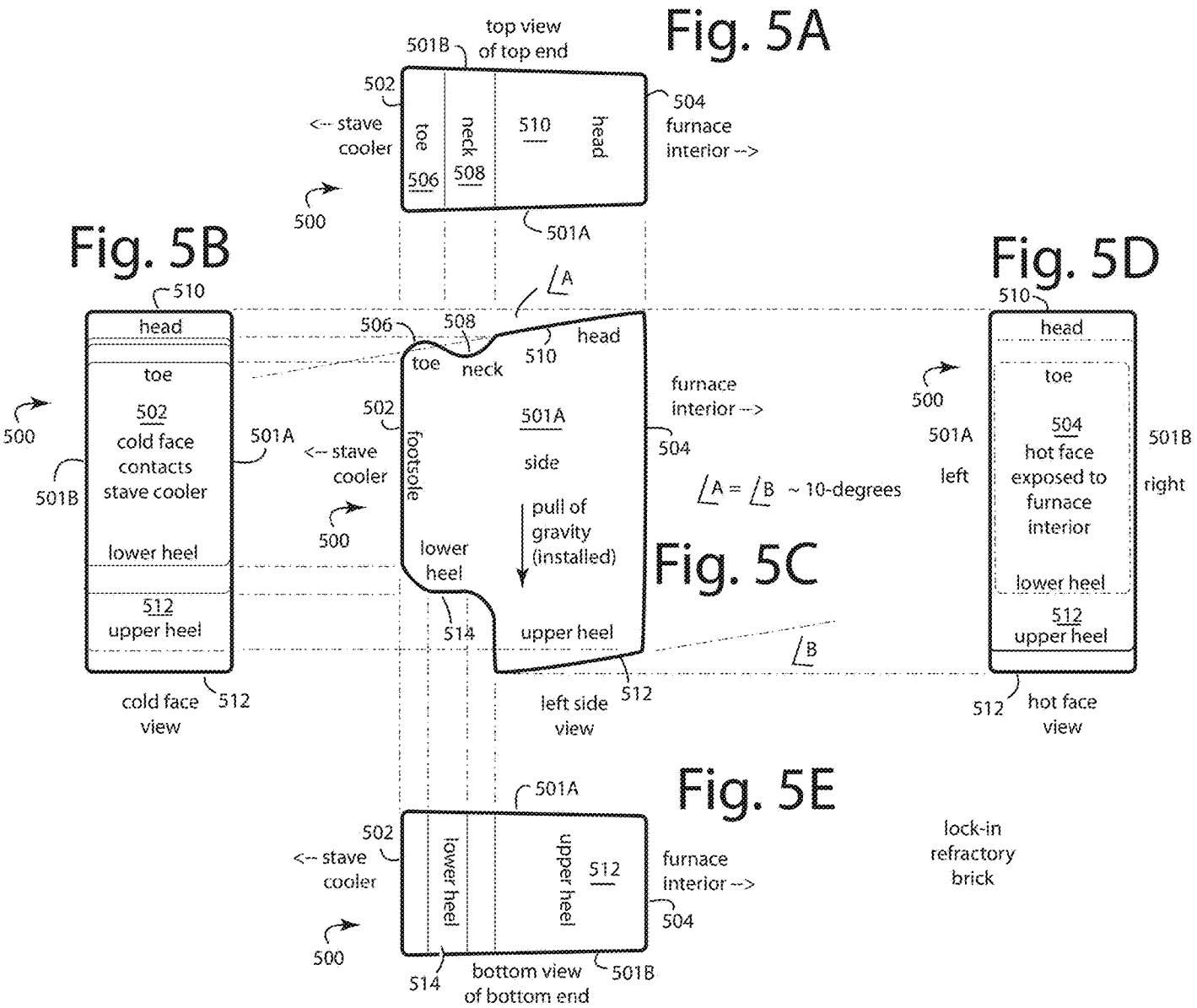
Fig. 5A
top view of top end
head
510
neck
508
toe
506
501A
501B
502
504
furnace interior -->
<-- stave cooler
500
Fig. 5B
head
510
toe
502
cold face contacts stave cooler
lower heel
512
upper heel
501A
501B
512
cold face view
500
Fig. 5C
head
510
neck
508
toe
506
footsole
502
501A
side
pull of gravity (installed)
lower heel
514
upper heel
512
left side view
504
furnace interior -->
<-- stave cooler
500
∠A = ∠B ~ 10-degrees
∠A
∠B
Fig. 5D
head
510
toe
504
hot face exposed to furnace interior
lower heel
512
upper heel
501A
left
501B
right
512
hot face view
500
Fig. 5E
lock-in refractory brick
512
upper heel
lower heel
501A
501B
514
502
504
furnace interior -->
<-- stave cooler
bottom view of bottom end
500

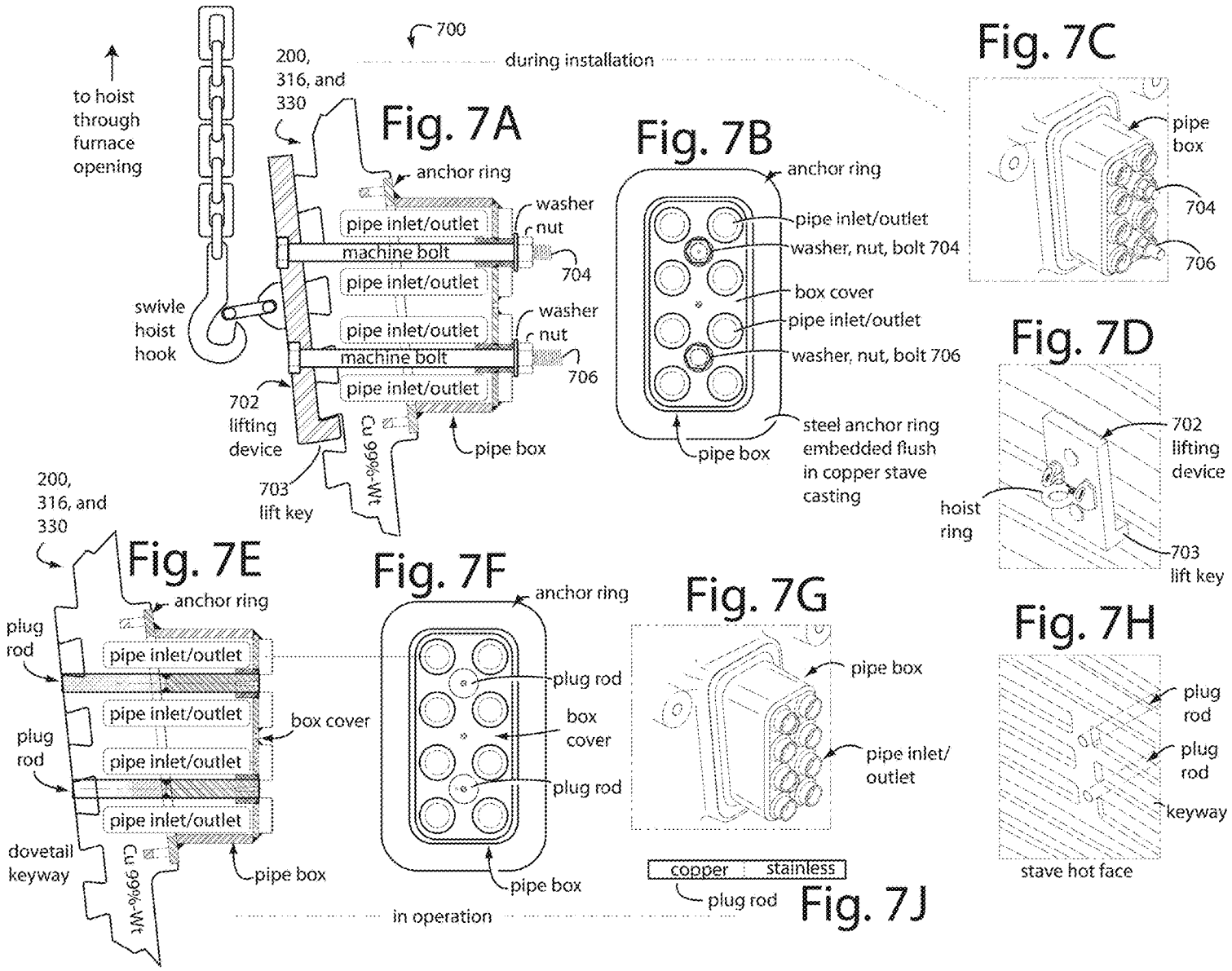
Fig. 7C
pipe box
704
706
Fig. 7D
702 lifting device
703 lift key
hoist ring
Fig. 7H
plug rod
plug rod
keyway
stave hot face
Fig. 7B
anchor ring
pipe inlet/outlet
washer, nut, bolt 704
box cover
pipe inlet/outlet
washer, nut, bolt 706
steel anchor ring embedded flush in copper stave casting
pipe box
Fig. 7G
pipe box
pipe inlet/outlet
copper
stainless
plug rod
Fig. 7J
700
during installation
Fig. 7A
anchor ring
washer
nut
704
washer
nut
706
pipe inlet/outlet
machine bolt
pipe inlet/outlet
pipe inlet/outlet
machine bolt
pipe inlet/outlet
pipe box
Cu 99%-Wt
200, 316, and 330
703 lift key
702 lifting device
swivle hoist hook
to hoist through furnace opening
Fig. 7F
anchor ring
plug rod
box cover
plug rod
pipe box
in operation
Fig. 7E
anchor ring
box cover
pipe box
pipe inlet/outlet
pipe inlet/outlet
pipe inlet/outlet
pipe inlet/outlet
Cu 99%-Wt
200, 316, and 330
plug rod
plug rod
dovetail keyway CuNi, NiCu pipe, inlet and outlet ends 812
805
threaded s/s couplers 814
steel pipe box 816
steel cover plate 818
outside-the-shell steel adapter plate 822
814-822
gas-tight to furnace shell
820
802
808
Casting Cu 99%-Wt
807
806
804
steel anchor ring 810
up
stave cooler 800
814
811
810

FURNACE BRICKS, COOLERS, AND SHELLS/BINDINGS OPERATING IN SYSTEMIC BALANCE

FIELD OF INVENTION

The present invention relates to furnace bricks, coolers, and shells/bindings for pyro-metallurgical furnaces, and more particularly to furnace bricks, coolers, and shells/bindings that interplay effectively while operating in pyro-metallurgical furnaces.

BACKGROUND

Modern pyro-metallurgical furnaces and especially blast furnaces must enclose heat so intense that the refractory crucible must be aggressively liquid-cooled. Very high temperatures are needed to reduce and melt iron ore and produce a high-carbon cast iron (pig iron).

Refractory brick linings wear very rapidly when they run too hot. So stave coolers are employed to keep the refractory brick lining temperatures under control, and wear to a minimum.

Vertical shaft blast furnaces vary in height from 24-33 meters and have hearth diameters of about 8.5 meters and are widely used in iron making. A typical blast furnace's volume runs more than 1400 $m^3$. Blast furnaces have charging arrangements at the top and a means of running off the pig iron and slag at the bottom. Hot air is blown in through tuyeres near the bottom of the furnace, which burns coke to produce carbon dioxide ($CO_2$). This then further reduces $Fe_2O_3$ to produce $Fe+CO_2$.

Conventional stave cooler and cooling panel designs have typically installed their refractory brick into grooves on the hot faces before installing the panels themselves inside the furnace shell. Many brick designs are intended to be installed on flat/parallel panels. One brick design was able to be installed in flat/parallel and curved coolers after the cooler was in place. When a furnace needs rework, such bricks that can be replaced or re-installed without removing the cooler offer a distinct advantage.

Stave coolers with pre-installed bricks are installed in the furnace with a gap in between them to allow for construction variances and thermal expansion allowance. Such gaps must be filled with mortar, castable, or rammed refractory to close the openings. Unfortunately, this fill material can be lost if the staves are not designed and installed properly.

The ram gaps erode during operation and furnace gases leak through between the staves. Prior attempts have been made to brick continuously around the furnace's circumference to eliminate the filled gaps. Hopefully increasing the integrity and life of the furnace. Any edges left protruding into the furnace are exposed to catching churning matter in the process.

Any exposed edges tend to wear rapidly and can cause the bricks to crack and break off. Missing brick or fill refractory exposes the stave to more serious damage.

Any good brick must be fully installable in tilted or angled walls. Conventional stave and cooling panel bricks were typically installed in straight grooves to keep the bricks in the coolers. Tapered bricks which were not locked into the grooves instead pushed against the cooler. Stave grooves can be used to lock-in the brick, and are tapered from back to front to key the brick in place. When the bricks inflate under heat, the tapered shapes help them push out against the cooler and reduce their thermal resistance.

Some staves have been installed without refractory brick in front of them. There may have been an initial coating of castable refractory for startup. These tried to freeze a skull layer for protection and insulation when operations began a blast furnace. Such skull is generated and spalled repeatedly in service. Each cycle of loss and regeneration leads to increased temperatures and stresses in the stave, eventually leading to cracking and the possibility of losing cooling fluid into the furnace. (Which can result in a powerful and very destructive steam explosion.)

Bricks that stay in place keep stave surface temperatures stable and more uniform. This allows for more consistent furnace operation and less heat loss and longer service life for the stave.

Skulls will only form in the cohesive zones of a furnace. So, a skull approach is not effective if the cohesive zone is not correctly determined. Unfortunately, the cohesive zones of furnaces can change with the charge material. Here too, brick refractory linings better protect the staves regardless of adhesion.

It is nevertheless appropriate to form a skull to protect the refractory similar to as in a basic oxygen furnace. Skull adhesion is lost in various sections in the furnace at different times. This results in non-uniform temperatures throughout the staves and furnace. A continuous circumferential brick pattern built around inside a furnace, and locked into the staves, can use thermal expansion to increase contact, and thereby maintain a uniform stave temperature. Uniform stave temperatures are good because they reduce stresses on both the furnace and staves, and both enjoy longer lives.

Some early locked-in brick designs were relatively thin, and so these bricks would crack easily and fall through into the furnace. Better bricks must increase thickness for better strength, and make them less susceptible to cracking.

In a so-called double-lock system, a keystone type taper to the sides was expected to hold broken bricks in place. Increased thickness was also predicted to allow the bricks to be installed faster. Any additional weight to the brick tended to keep them in place better and less susceptible to failure. Many older stave designs which put bricks in walls in front of the staves needed many bricks. The joints between them got in the way of effective cooling, especially cooling of those bricks furthest from the stave cooler. Artisans later found it better to incorporate only one brick in tight contact with the stave coolers, e.g., to eliminate any thermal barriers that multiple mortar joints would introduce.

SUMMARY

Briefly, a refractory brick embodiment of the present invention finds use as one of many substantially identical refractory bricks which are assembled into completed horizontal ring rows neatly nested into laterally curved copper stave coolers surrounding the ring. Each brick "locks" into horizontal channels between pairs of parallel horizontal protruding ribs on the hot faces of the copper stave cooler. Every copper stave cooler is provisioned with a full covering of the refractory bricks after the copper stave cooler is mounted inside a corresponding steel containment shell. None of the refractory bricks are permitted to be finished bridging between adjacent copper stave coolers in the same horizontal row. Each brick is installed in their respective copper stave coolers with crushable or deformable mortar filling the channels. Each brick hooks a "toe" just under and into an upper of the pair of horizontal ribs, and then rotates in down with favorably oriented and directed earth's gravity to stay in place at least until a next upper row of bricks in a superior horizontal ring "lock" them in a second way.

SUMMARY OF THE DRAWINGS

FIGS. 4A-4D represent a method of pinning the bricks in place after each has been initially locked in. FIG. 4A is a first diagram in a sequence that represents a brick with a pre-drilled hole from the top down to the heel. This is intended to line up with a blind hole pre-drilled into a lower horizontal rib. FIG. 4B is a second diagram in the sequence that represents inserting a metal pin into both pre-drilled holes all the way down into a lower horizontal rib. FIG. 4C is a third diagram in the sequence, the metal pin has stopped short and the space above it is filled with mortar. Then a next new row of bricks above can be toed-in and rotated down to lock in. FIG. 4D is a fourth and final diagram in the sequence that represents the brick settled into the next upper row;

FIG. 5A-5E are top, rear, left side, front, and bottom view diagrams of one embodiment of the present invention for any of the bricks shown in FIGS. 1, 2A, 2B, 3A, 3B, and 4. Many other ways, sizes, arrangements, materials, and shapes of bricks could accomplish the same ends of locking into stave coolers while maintaining good thermal contact with all their surrounding and substantially identical bricks and the stave coolers they mount to;

FIGS. 7A-7J are diagrams of a method of installation using a lifting device and conventional hoist. A copper/stainless rod plug is welded or threaded in to close the two holes that were temporarily needed for the two bolts to fasten to the lifting device;

DETAILED DESCRIPTION OF THE EMBODIMENTS

Figure 1:
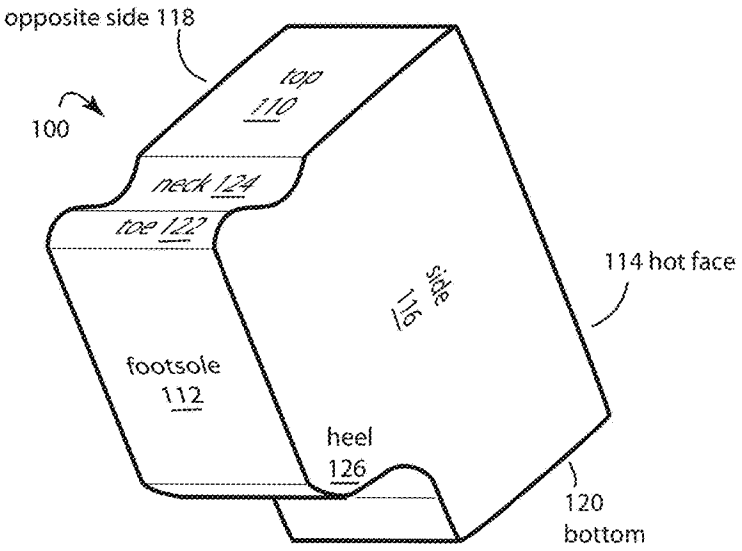
FIG. 1 is a perspective view diagram of a refractory brick embodiment of the present invention in a so-called double-locking version for use in a pyrometallurgical furnace and mounted on copper stave coolers with regular horizontal rows of ribs and channels dimensioned to hold a plurality of identical such bricks.

Bricks used in iron making are typically made of very thermally conductive carbon, graphite, and/or silicon carbide. Other types of bricks used elsewhere are made of magnesia, silica, and alumina and so are not very thermally conductive. With these, operational hot face temperatures can vary wildly. Some brick patterns are not likely to be effective as brick with lower thermal conductivity as they tend to be used in processes which corrode more quickly. High alumina is also used for bricks due to its good wear resistance, but slag will corrode it more than non-wetting materials such as silicon carbide and carbon based. Magnesia based bricks are less resistant to wear. Iron and steel making do not use any chrome, to avoid disposal issues and generating toxic hexavalent chromium, but its use is common in nonferrous pyrometallurgy.

If bricks are lost due to corrosion, those remaining on the hot face will not be very effective at holding onto frozen accretions. If the bricks crack, wear or corrode too much, they can also simply fall out. If nothing is locked into place after one ring is lost, then their next rings near will be unstable. Large parts of the lining can slowly unzipper.

Embodiments of the present invention are especially beneficial in furnace applications where the heat flux facing the copper stave coolers exceeds 25 kW/m$^2$. The materials used for, and the three-dimensional shape of the brick, are limited in embodiments of the present invention by computational fluid dynamics (CFD) and finite element analysis (FEA) computer modeling in iterative steps of trial-and-error selections for the materials used for and the three dimensional shape of the brick with boundary conditions that include a given required campaign life and a predicted operational heat flux in excess of 25 kW/m$^2$.

For a small temperature rise, FEA can be used on its own without the need for CFD. If a significant temperature rise (e.g., larger than five degrees Centigrade) will occur, then it is best to run a CFD model to estimate the temperatures and convection coefficients between the pipe and the cooling medium. Fluid properties will change with temperature, and larger temperature rises prevent every block from being evenly cooled because the coolants gain heat as they circulate from the inlet to the outlet. Although this is unavoidable, the design and layout should achieve as much evenness as is possible to keep thermal stresses to a minimum.

CFD is a branch of fluid mechanics that uses numerical analysis and algorithms to solve and analyze fluid flows. Computers assist in calculations to simulate interactions of liquids and gases with surfaces defined by boundary conditions. FEA is a computerized method to predict the effects of vibration, heat, and other physical phenomena. FEA can be used to predict temperatures and stresses. Commercial software products can be used to simulate interactions of physics, structural, vibration, fluid dynamics, heat transfer and electromagnetics for engineers. Simulation of working conditions in virtual environments is employed before manufacturing any product. The 3D simulations in virtual environment help determine and improve failure points, campaign life, and identify problems.

FIG. 1 represents a refractory brick 100 in an embodiment of the present invention that assembles into horizontal ring rows of substantially identical bricks. These are in turn assembled and stacked together several rows high to form a cylindrical crucible wall lining in a pyrometallurgical furnace. See FIGS. 3A and 3B.

Each brick principally comprises a refractory material like carbon, graphite, or silicon carbide that has been three-dimensionally machined, molded, or otherwise formed into a useful brick shape and to a particular tolerance. Curved brick surfaces are expensive to produce on bricks, and so flat/parallel surfaces are more practical and used instead.

A flat/parallel top surface 110 is oriented relative to the earth's gravity after being installed in a furnace as one brick in at least one complete horizontal ring comprising a sufficient plurality of substantially identical bricks. Mortar or adhesive is applied on a flat/parallel back surface or foot sole 112 to ensure a good thermal contact with a cooler.

The mortars and adhesives used must be selected to accommodate differential expansion between the metal and the brick.

A front hot face surface 114 faces an incoming heat flux that can exceed 25 kW/m$^2$. A pair of opposite flat/parallel sides 116 and 118 may require mortar to finish after assembly in a furnace in good thermal contact shoulder-to-shoulder with the other substantially identical bricks in a complete ring inside the furnace. Any thermal resistance issues at brick-to-brick interfaces can be addressed with material-compatible mortars and adhesives. A flat/parallel bottom surface 120 has also to make good thermal contact with the top surface 110 of a next lower row of substantially identical bricks in the plurality of substantially identical bricks, where mortar may again be used to improve thermal contact.

In alternative embodiments of the present invention, foot sole 112 has a protruding toe 122 that is separated from top surface 110 by a neck 124. A heel 126 is shaped to rest on a horizontal rib of a laterally curved copper stave cooler. These are important in a so-called double-locking arrangement.

Laterally curved copper stave coolers have an advantage where many of them are placed in staggered rows inside a cylindrical containment shell. When substantially identical bricks are installed into all the channels between all the ribs, none of the exposed faces of any brick will protrude beyond any other. Such is not possible with flat/parallel staves arranged in staggered rows. Protruding bricks are a source of trouble because the upward edges will catch downward flowing material in the core of the furnace. More often than not, such will cause the brick involved to crack and large pieces can fall out easily once they are cracked. The lateral curve radius of the staves should of course be appropriate for the given radius of the containment shell they will be used in.

It may be advantageous to drill and insert pins in brick 100 to keep it in place if a lot of wear is expected. As for cast linings, it could be useful to mix in stainless steel needle with the refractory to add strength. Mixing in stainless steel needles helps distribute the tensile stresses better, and the refractory then only flakes and exfoliates, rather than spalls.

Figure 2A:
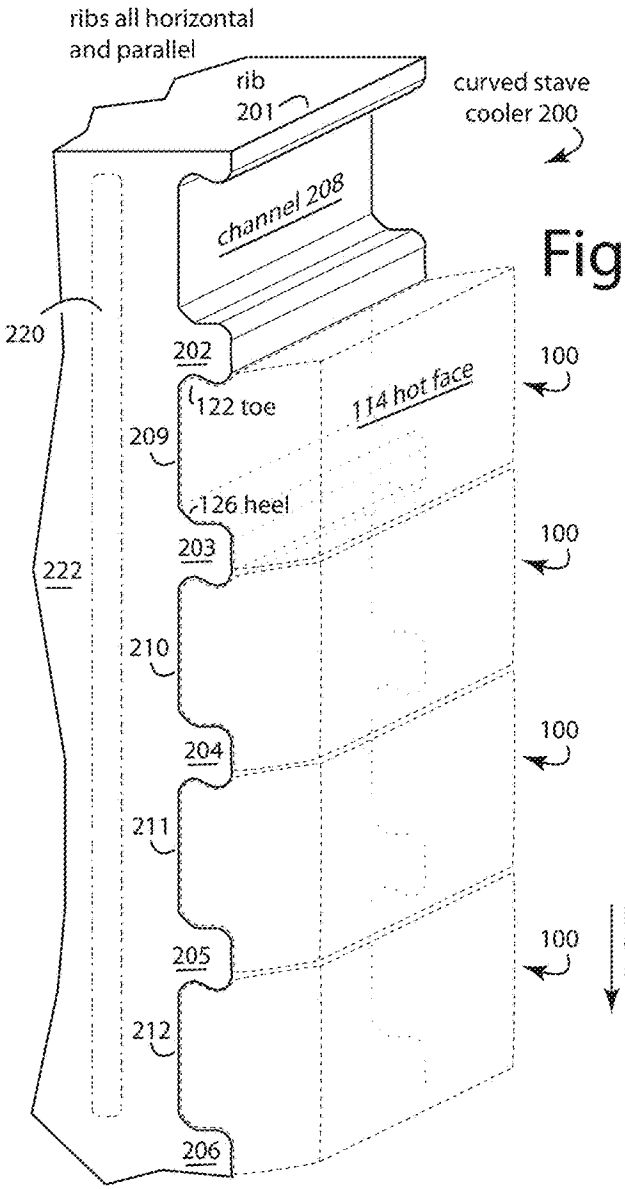
FIG. 2A is a perspective view diagram of a copper stave cooler embodiment of the present invention with regular horizontal rows of ribs and channels that are dimensioned to hold a plurality of substantially identical refractory bricks like that of FIG. 1 and in which lower rows of such bricks are inserted and completed in rings around the inside of the pyrometallurgical furnace before a next upper row and continuing until a wall of refractory bricks is completed.
Figure 2B:
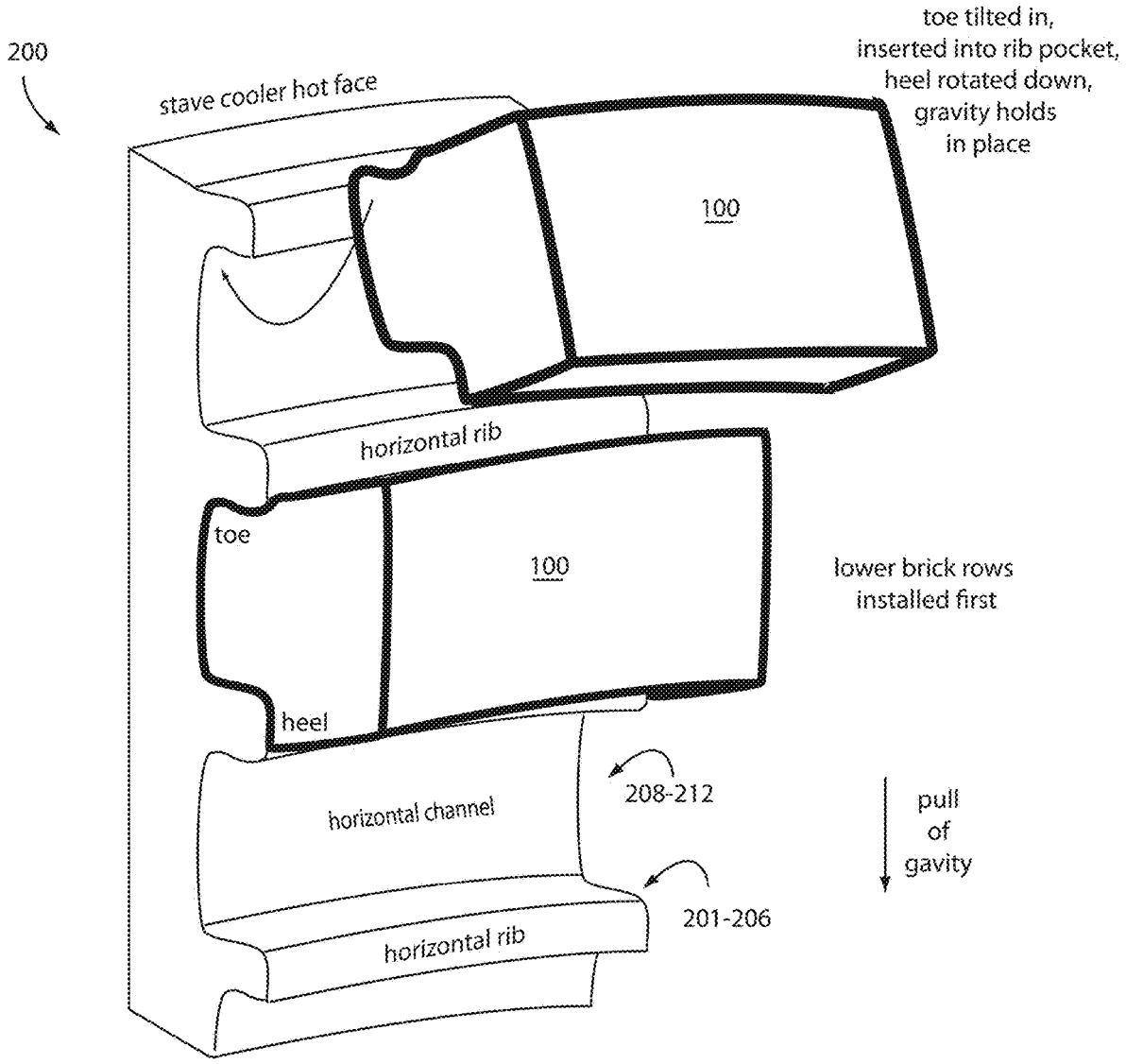
FIG. 2B is another perspective view diagram of the copper stave cooler of FIG. 2A demonstrating how the bricks are to be tilted into the channels and locked under an upper horizontal row of ribs, rotated cooperatively with earth's gravity into the respective channels and thus lock and prevent bricks in the next lower row from unlocking because they are blocked by the upper bricks from rotating.
Figure 2C:
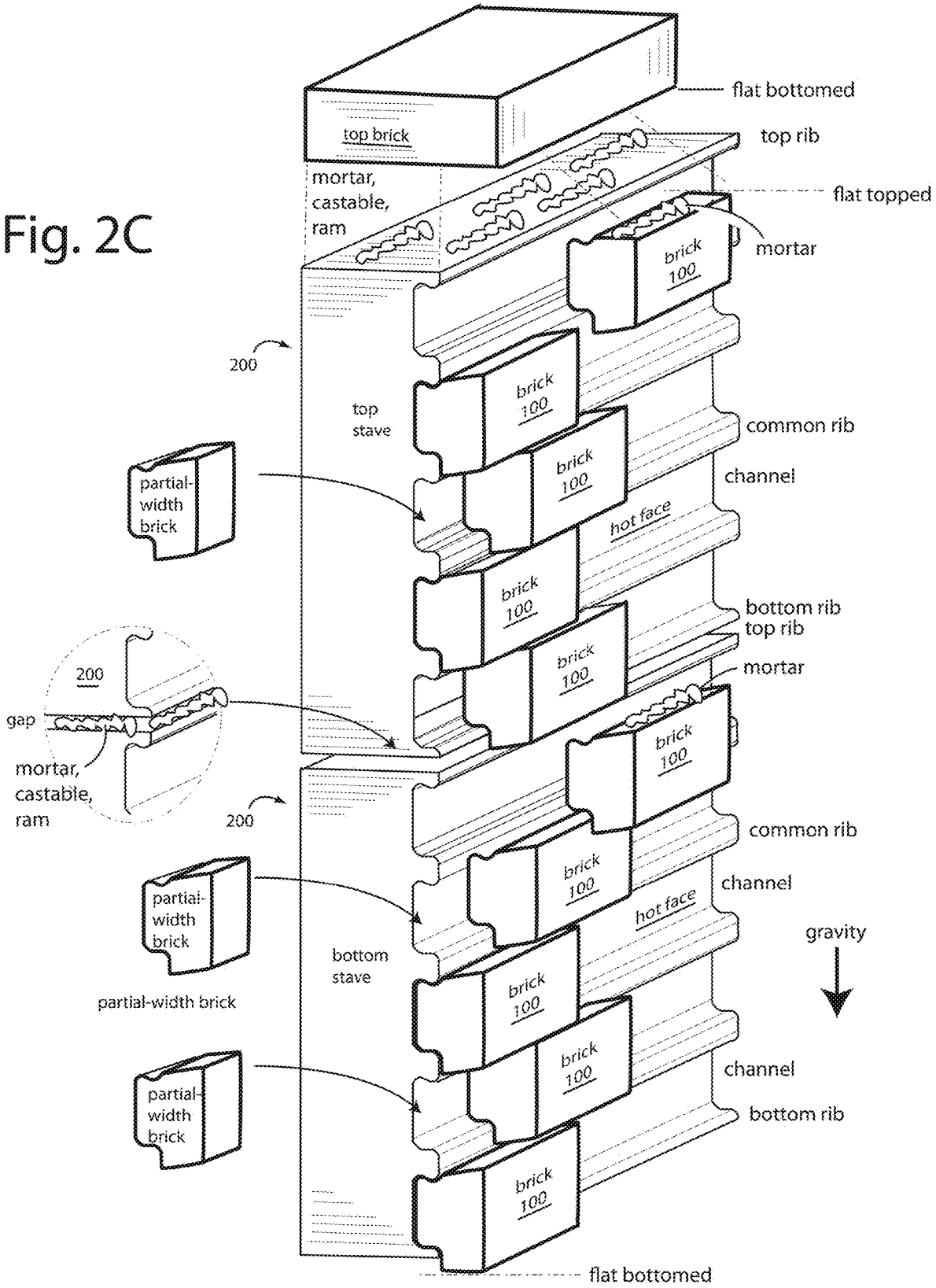
FIG. 2C is another perspective view diagram of two of the copper stave coolers of FIGS. 2A and 2B demonstrating how partial width bricks and full bricks are used to create horizontal staggered rows that fill each horizontal channel between ribs. Some bricks may need to be field cut to maintain proper gaps for thermal expansion allowance. The top and bottom ribs of the stave coolers are shown how they are abbreviated so that when joined above and below regular bricks will fit and continue up vertically in horizontal rows.

FIGS. 2A-2C represent laterally curved copper stave coolers 200 in an embodiment of the present invention that can be afforded wear protection from abrasion, corrosion, oxidation, and other forces by retaining a lining of bricks 100 assembled into a complete covering. The individual bricks 100 are insertable into laterally curved stave cooler 200 after it has been installed inside a steel containment shell of the pyrometallurgical furnace. E.g., working up in complete rows starting at the bottom. Each upper row "locks in" the rows below. Lateral curving of the stave cooler the bricks mount to is important because it directs the brick walls to bow out away from the furnace center and tighter into the stave coolers themselves.

Flat, conventional stave coolers have been observed to suffer inward bowing of the brick lining and loss of thermal contact with individual bricks. Such bricks lose cooling, then experience rapid wear from that point. This phenomenon is even more pronounced in rectangular furnaces.

A number of evenly spaced and horizontal ribs 201-206 are uniformly separated by a matching number of channels 208-212. In this one embodiment, cooler 200 comprises at least one CuNi pipe coil 220 set inside a high purity copper (99%-Wt) casting 222. The CuNi pipe coil 220 has a front copper cover between it and the channels 208-212 that has been positioned according to computer modeling of thermal and shear stress forces inside casting 222. Different embodiments will be made of high purity cast copper with different copper or nickel alloy pipe coils.

Referring again to FIGS. 2A-2C, refractory brick 100 is further three-dimensionally formed such that the brick will be self retained and held in thermal contact with a laterally curved stave cooler 200 respective one of the outer ring of laterally curved stave coolers having a plurality of evenly spaced horizontal ribs on a hot face surface wherein, each brick is mechanically enabled to be self retained between respective and adjacent upper and lower pairs of the plurality of evenly spaced horizontal ribs by tilting in the top surface toward and tucking it in to lock under an upper rib, and then rotating the bottom surfaces down in the same direction as the pull of earth's gravity and inward to nest its back surface into a matching channel between the pair of horizontal ribs wherein, the pull of earth's gravity is sufficient to retain the brick in place without falling out.

A spread of crushable or deformable mortar, or adhesive, is placed between the back surface of the brick and the channel between the pair of horizontal ribs in the laterally curved stave cooler such that thermal contact is improved by an elimination of any gaps that would otherwise increase thermal resistance wherein the brick is immobilized thereby in the hot face of the cooler and cannot loosely wiggle, wobble, or be forced out.

Any mortar used with bricks 100 is selected to be the weakest of the materials it contacts. If the mortar were to be stronger than bricks 100, the bricks could be cracked in tension and fall off in large pieces. Brick is weak in tension, and it is most prone to cracking at a lock-in part of any joint. Contact mechanics is included in numerical modelling software to estimate stress fields due to the complex mating of round and flat/parallel surfaces.

FIG. 2C demonstrates how partial width bricks and full bricks are used to create horizontal staggered rows that fill each horizontal channel between ribs. The top and bottom ribs of the stave coolers 200 are abbreviated, so that when joined above and below regular bricks will fit and continue up vertically in horizontal rows. This may, however, cause these bricks to crack if done as simply as illustrated.

A top brick in a full horizontal ring row of them protects the tops of staves 200 when positioned in the furnace in a topmost row. An optional taper underneath matches with the upward tilt of the top brick and helps keep both in place.

Vertically directed thermal expansion can cause bricks 100 to fail if they bridge between staves 200, as shown in simple FIG. 2C. Extra material should be added in for expansion allowance, because the staves are at fixed elevations in the shell. Lime (CaO) based castables or rammix visit a softening stage after heating and many finish in a net shrinkage after heating. Rammix is a semi-plastic mass ramming mixture. Phosphate bonded castables are stronger after initial placement.

Embodiments of the present invention prefer to use mortar up to about three millimeters thick, castable is used for gaps more than three millimeters, and ram starting about thirty-five millimeters or more. Mortar use on hot face gaps is discretionary.

Carbon bonded castable and rammix are also good alternatives here. A sort of top brick could be inserted between rows of stave coolers 200 with a fill layer of castable or mortar. The fill is formulated to crush soonest to deflect forces generated by differential thermal deformation as the stave cooler 200 expands with heat. The fill crushing first saves the bricks 100 from cracking. Alternatively, a rammix which keeps its strength, but shrinks after heat up could also be used here.

Shelf bricks need to be tapered to make room for the castable needed to hold the bricks to the wall. Otherwise, shelf bricks can get pulled off as process furnace material very slowly moves downward in the core. Flat surfaces on the vertical face ends of the staves are typically used to help in forming a V-shape to hold castable in between the stave coolers 200.

Copper, as opposed to brick, is about equal in its expansion and contraction characteristics, and performs about the same in both tension and compression. However, copper does not have a well-defined yield stress and can creep at about a third of its stated yield stress, and which is common for nonferrous alloys.

Powder from any crushed mortar will stay in position if its space is well confined. Where the gaps stay small, so too will the thermal resistance remain small. There is a lot of variance in mortars, in one type the compressive strength of is about 2.5 MPa at 110° C., and about 5.0 MPa at 1100° C. Often these mortars will not reach 1100° C. because of the cooling.

Under thermal cycling, bricks will expand then contract, then expand again. Any burden, charge, frozen or molten material on the front of the brick, will act to keep the bricks in their places. One risk is that if the bricks contract at all, then loosened crushed mortar powder can fall and collect in the bottom of a larger gap, the uneven filling of the gap produces uneven heat increases in brick temperature rise. It is preferable if the mortar that crushes stays in place, which does happen with some carbon based materials. There are many mortars available, so it is advantageous to select one which performs well for the long term in case, the bricks are computer modelled to probably move under predictable thermal cycling.

Embodiments of the present invention require that gaps between rows of staves be filled with mortar, castable, or rammed refractory to accommodate for a predetermined thermal expansion allowance. Installation failures to get these thermal expansion allowance gaps right will result in brick cracking, cooler exposures, and other catastrophes that shorten furnace campaign life.

If the coolers are curved to match the forming of individual bricks into a ring shape, then with an increase in temperatures, the ring as a unit will expand outward deeper and tighter into their respective coolers, which is typical with circular furnaces.

Figure 3A:
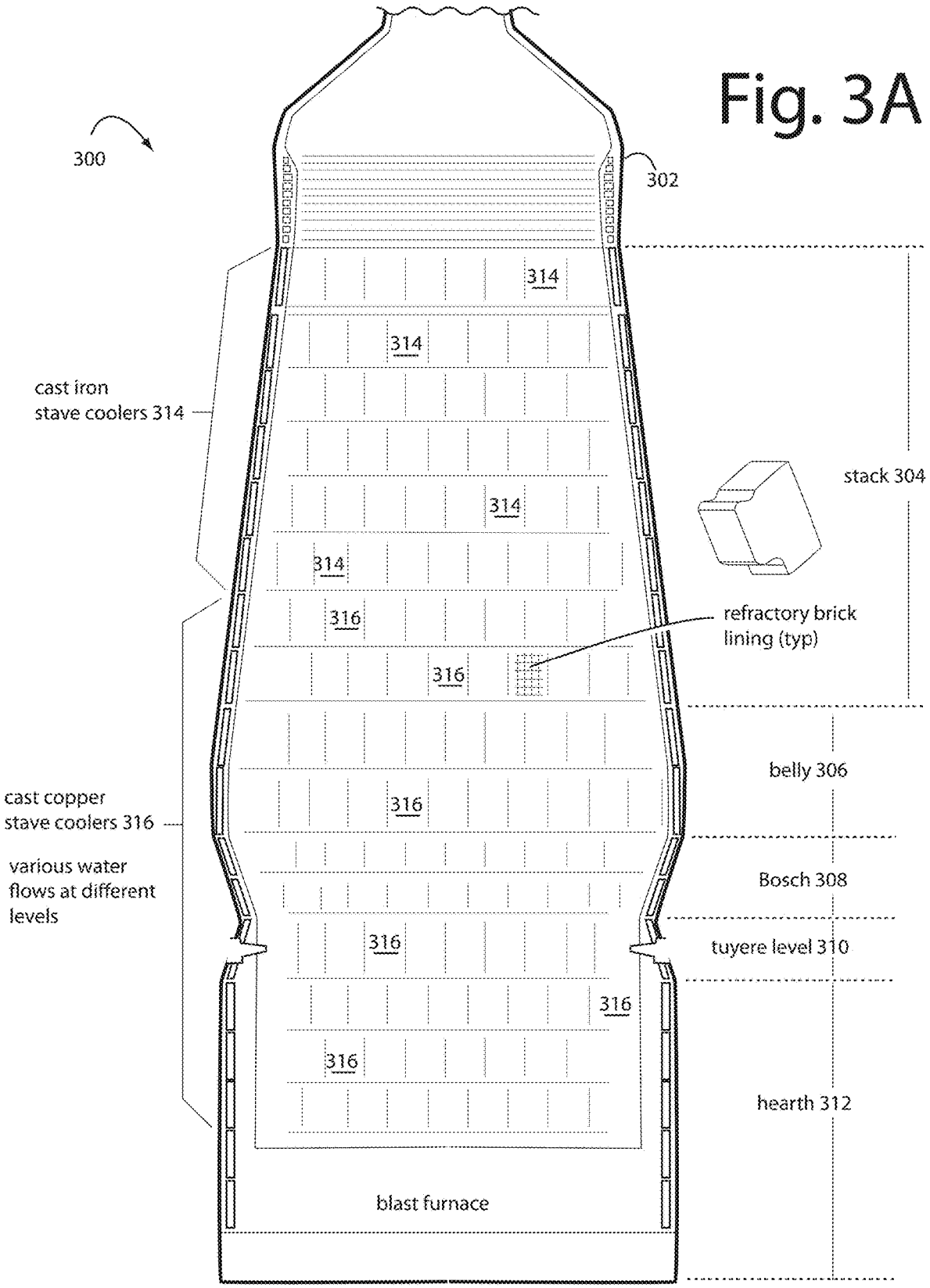
FIG. 3A is a schematic view diagram of a pyrometallurgical furnace embodiment of the present invention with an outer containment shell inside of which the copper stave coolers and bricks of FIGS. 1, 2A, 2B are mounted.
Figure 3B:
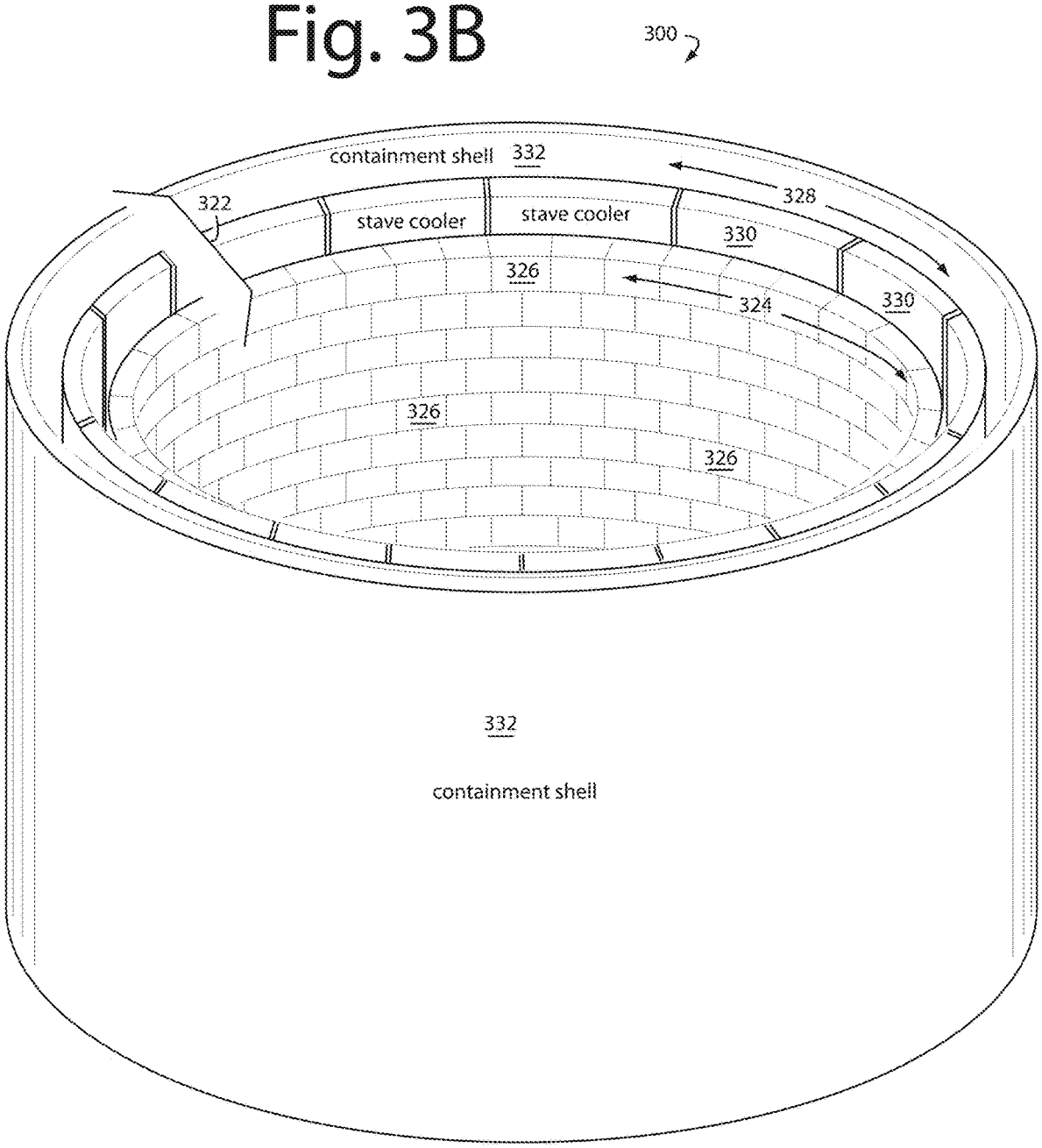
FIG. 3B is a diagram representing the arrangement geometry of how the bricks and coolers and containment shell of FIGS. 1, 2A, 2B, and 3A are nested brick rings inside stave cooler rings, and stave cooler rings inside the cylindrical containment shell, all to advantageously cause the rings of bricks to grow outwards and press harder into their surround rings of stave coolers and thereby reduce thermal resistance such that the bricks will operate at reduced temperatures during the campaign life.

FIGS. 3A and 3B represent a blast furnace type of pyrometallurgical furnace 300 with a roof 302, a stack 304, a belly 306, a bosch 308, a tuyere level 310, and a hearth 312. Cast iron stave coolers 314 will provide good service in the upper stack 304 because heat flux doesn't generally exceed 25 $kW/m^2$. Special high heat flux cast copper coolers 316 are required below in the lower stack 304, belly 306, bosch 308, tuyere level 310, and hearth 312 because heat flux will generally far exceed 25 $kW/m^2$. Particular high heat flux cast copper coolers 316 here can receive 3-4 times the heat loads, and therefore require 3-4 times the coolant flows their comrades do.

Bricks used above the cohesive zone can appropriately use all silicon carbide materials for their superior abrasion resistance. But using all silicon carbide brick produces stresses that will be higher. It is therefore preferable to use bricks with higher compressive strengths and modulus of rupture.

Refractory bricks 314 made of silicon carbide are stacked in high walls of substantially identical bricks assembled into horizontal ring rows. That is with respect to the pull of earth's gravity. Below those, refractory bricks 316 typically made of graphite are stacked in high walls of substantially identical bricks assembled into ring rows. Refractory bricks 314 and 316 are possible embodiments of brick 100.

FIG. 3B represents a portion of furnace 300 in FIG. 3A, with a draftsman's view into the interior. A geometric arrangement 322 of completed horizontal rings 324 of substantially identical bricks 326 inside and mounted brick-by-brick to respective ones of an outer ring 328 of laterally curved stave coolers 330 that are, in turn, themselves mounted to and supported by a still more outer furnace containment shell 332. The arrangement geometry 322 is such that a difference in the coefficients of thermal expansion and temperatures of the complete horizontal ring 324 of substantially identical bricks 326 is advantageously directed into pressing the flat/parallel back surfaces 112 (FIG. 1) of bricks into increased thermal contact with a surrounding outer ring of coolers 328. The difference in the coefficients of thermal expansion and temperatures is further assisted in increasing the thermal contact with a mortar placed in between that can accommodate crush and fix each brick into place and not permit loose movements. A lack of pressure of the bricks into the stave coolers will increase the thermal resistance between them. Such then leads to elevated brick temperatures and a proportionately reduced campaign life.

FIGS. 4A-4D represent a triple-locking rotate-in-to-lock refractory brick 400. Silicon carbide and graphite bricks can be press molded to rather tight dimensional tolerances. Graphite can also be machined to less than ±1.5 mm. These rotate-in-to-lock refractory bricks 400 require a matching contoured hotface on a laterally curved copper stave cooler 402. Regular rows of ledges 406 with chins 408 drop down over a flat/parallel pocket 410 to the next ledge 406 below. The matching bricks 400 include a toe 412 that tucks under each chin 408 and is rotated down with a foot sole 414 into the matching pocket 410 until a heel 416 settles onto the ledge 406. The brick 400 has a flat/parallel top 420, a slightly horizontally concave face 422, and a flat/parallel bottom 424.

The rotate-in-to-lock refractory brick 400 will not function properly if it is not used at a correct relative orientation to earth's gravity. FIG. 4 shows the correct relative orientation to earth's gravity with the "gravity" arrow pointing down.

Bricks 400 should be installed in a complete horizontal ring row across a stave of blast furnace 300 before proceeding during installation to a next upper row. Any brick installed in a row above would prevent the top 420 from rotating up because it would contact and be stopped by the bottom 424 of the brick above. Thus without more, a "double-lock" is realized.

FIGS. 4A-4D further represent a series of steps in a method for triple-locking refractory bricks 400 (undrilled 100 in FIG. 1) into the stave coolers 200 (FIGS. 2A, and 2B). These show in greater mechanical detail the necessity in both the double-locking and triple-locking versions of setting the tilt of a flat/parallel top 420 and bottom 424 brick surfaces parallel. And at the same angle so that the drilled bricks 400 will mate well and nest completely with the next upper and lower rows of bricks. Such is necessary to ensure good thermal contact.

Figure 4D:
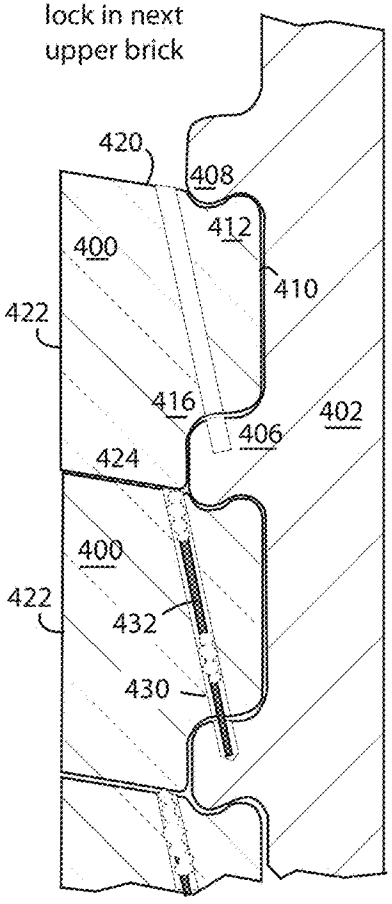
FIGS. 4A-4D are a series of cross sectional view diagrams of a so-called triple-locking version of the bricks and stave cooler of FIGS. 1, 2A, and 2B, and is intended to show in greater mechanical detail the necessity in both the double-locking and triple-locking versions of setting the tilt of the flat/parallel top and bottom brick surfaces parallel and at the same angle so that they mate well and completely with the next upper and lower rows of bricks and will thereby provide good thermal contact.
Figure 4C:
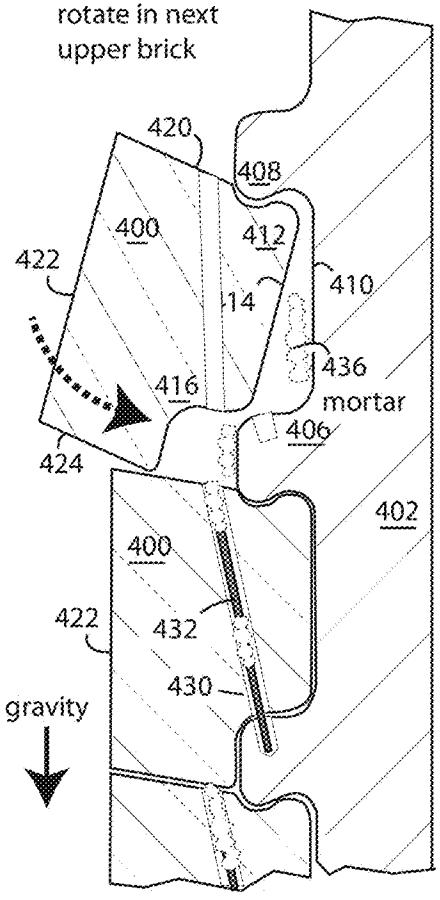
Figure 4B:
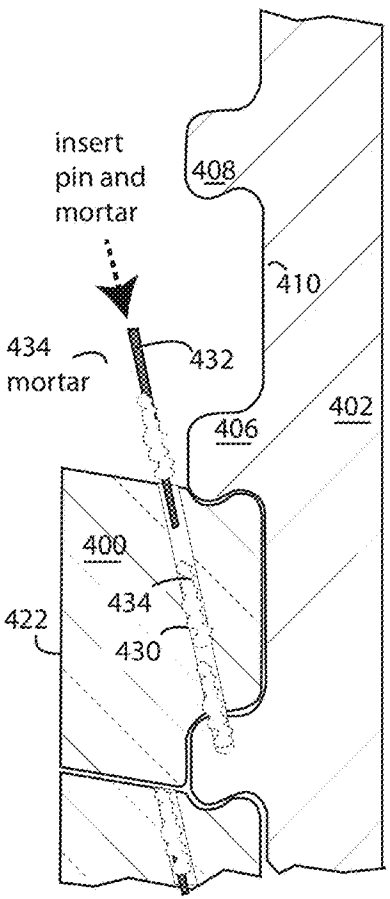
Figure 4A:
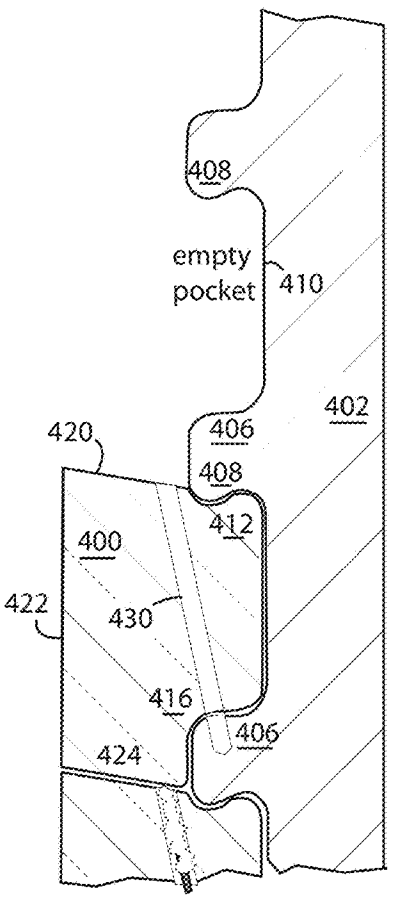

The method for pinning the bricks in after each is initially locked in begins in FIG. 4A, a hole 430 is pre-drilled into the top down 420 into a blind hole in lower horizontal rib 406. Copper is difficult to drill in the field, so the blind hole is preferably pre-drilled at the factory.

In FIG. 4B a mortar 434 is injected and a metal pin 432 is inserted into the hole all the way down into a lower horizontal rib 406. In FIG. 4C, a pre-drilled brick 400 is inserted with mortar 436 spread on foot 414 and locked into the next upper row and pocket 410. FIG. 4D represents pre-drilled brick 400 settled into the next upper row ready to install the pin.

Metal pin 432 can be much shorter and hole 430 backfilled behind it with mortar 434. A drift would be used to seat the pin into the blind hole on the rib.

FIGS. 5A-5E represent a brick 500 similar to bricks 100, 314, 316, and 400. The implementation of embodiments of bricks that can rotate in and double lock, and then fit properly into horizontal ring rows of substantially identical bricks, requires careful attention to the finished profiles and surfaces. Although the corners and edges are normally finished sharp, it may be beneficial if some or all are eased, chamfered, or rounded. Stresses can be concentrated in sharp corners and edges, so easing, rounding, or chamfering then can be helpful in reducing failures.

Brick 500 is generally comprised of silicon carbide, graphite, or carbon. It "toes-in" on a pair of flat/parallel sides 501A and 501B from the cold face that contacts the stave cooler to the hot face that faces into the center of the furnace. That inward narrowing help brick 500 fit better into a horizontal ring of substantially identical bricks 500.

The cold face includes a foot sole 502 that parallels a hot face 504. The upper end of foot sole 502 terminates in a protruding toe 506 that rounds over the top and down into a neck 508. Neck 508 turns back up at about 10° to a flat/parallel ramp head 510. Then head 510 eases and rounds back down into flat/parallel hot face 504. A flat/parallel bottom 512 parallels head 510 and matches its 10° tilt. Underneath, flat/parallel bottom 512 turns up into an upper heel 514 and through a radius to foot sole 502.

"Bricks" made of cast iron or other abrasion resistant metal could be shaped like bricks 400 and 500 and be usefully applied. Mortar or adhesive would again be beneficial for both improving thermal contact between the inserts and the staves, and an accommodation to absorb differential thermal expansion.

The full weight of every brick 400 or 500 is carried by their respective laterally curved stave coolers 402 and 502 because they each fully rest on the horizontal rows of ledges 406 and upturned ribs 506. This means that wear that thins the bricks from their faces can be allowed to continue years longer because the bricks don't have to support any brickwork above. Sudden collapse is not a problem.

Bricks, coolers, and shells/bindings must all work together in balance as a system, not as independent individual elements.

Differential Thermal Expansion Cannot be Ignored

It is preferable to laterally curve the staves to leverage differences between the differential thermal expansion of the bricks and the stave coolers. Placing castable, brick, or rammed refractory between staves is important during the installation.

Holes for thermocouples, wear monitors, and other devices can be drilled later after installing the brick. E.g., because it would be difficult to place the brick beforehand to line up with the holes in the shell. If the brick are not well locked into place, then drilling could loosen them (another good reason to use to mortar or adhesive to lock them in fully).

Mortar is required between a metal stave and the brick to close gaps and to accommodate clearances required to install the brick. Mortar is generally indicated for gaps under three millimeters. The back of the brick must be flat, as it is difficult to machine a curved surface onto the back of the brick on three dimensions (too complex to be practical). Mortar or adhesive is put between bricks if needed for a) expansion allowance, or b) holding the brick in place during the initial installation, and to fill the small gap between the curved stave and the flat face of the brick. Mortar is not always installed between bricks. Mortar is commonly installed between brick and copper castings to reduce the thermal resistance at the interface.

The brick must be made of a particular refractory material that thermally expands when heated. And that can grow in small permanent increments in furnaces over time due to metal absorption.

A mortar gap must be included for thermal expansion allowance both vertically between the horizontal ribs, and alternatively between adjacent horizontal ring rows of bricks.

Introducing thin layers of mortar into the CFD-FEA computer modelling is required for the most accurate thermal and stress analyses.

Previously, slide-in brick designs have been used by many companies, but those coolers must be flat/parallel. Some designs alternate the materials (carbon, SiC in iron making blast furnaces, basic or alumina brick more often in nonferrous). Such coolers are used in walls and roofs, in both ferrous and nonferrous furnaces. Mortar has been used as a lubricant to make it easier to slide in bricks, and to reduce thermal contact resistance.

It is highly beneficial to round every corner to avoid stress concentrations. Bricks are weak in tension but strong in compression. Sharp corners are to be avoided on the coolers as well, as they can act as sites for crack initiation.

The three-dimensional heat transfer and thermal stresses of laterally curved stave coolers in a blast furnaces can be modeled and analyzed. The stress field due to temperature, gravity, and mechanical loads of laterally curved stave coolers can be calculated by using a finite element method software.

Individual staves are not likely to line up horizontally from ring to ring. Also, individual staves can bend due to temperature and pressure. If a single brick were connected to staves in two rings, then it would likely crack, and it would also restrict differential vertical expansion of the two rings (ring 1 will expand downwards more than upwards if the can it close to the top). Any stave when heated predominantly from one side will attempt to bend. A rectangular shaped stave will want to bow into the furnace due to thermal expansion, regardless if it is curved or flat. Curving the hot face of the stave and making the hot face brick in rings forces the refractory to expand outward to contact the metal stave, regardless of whether the rings are continuous around the furnace or just across a single stave. Hence, there will be an incompatibility or rotations at the interface of two staves at the top and sides. Brick which cross from one stave to another within a row will be subjected to bending by the staves, which can lead to cracking of the brick.

Figures 6A, 6B:
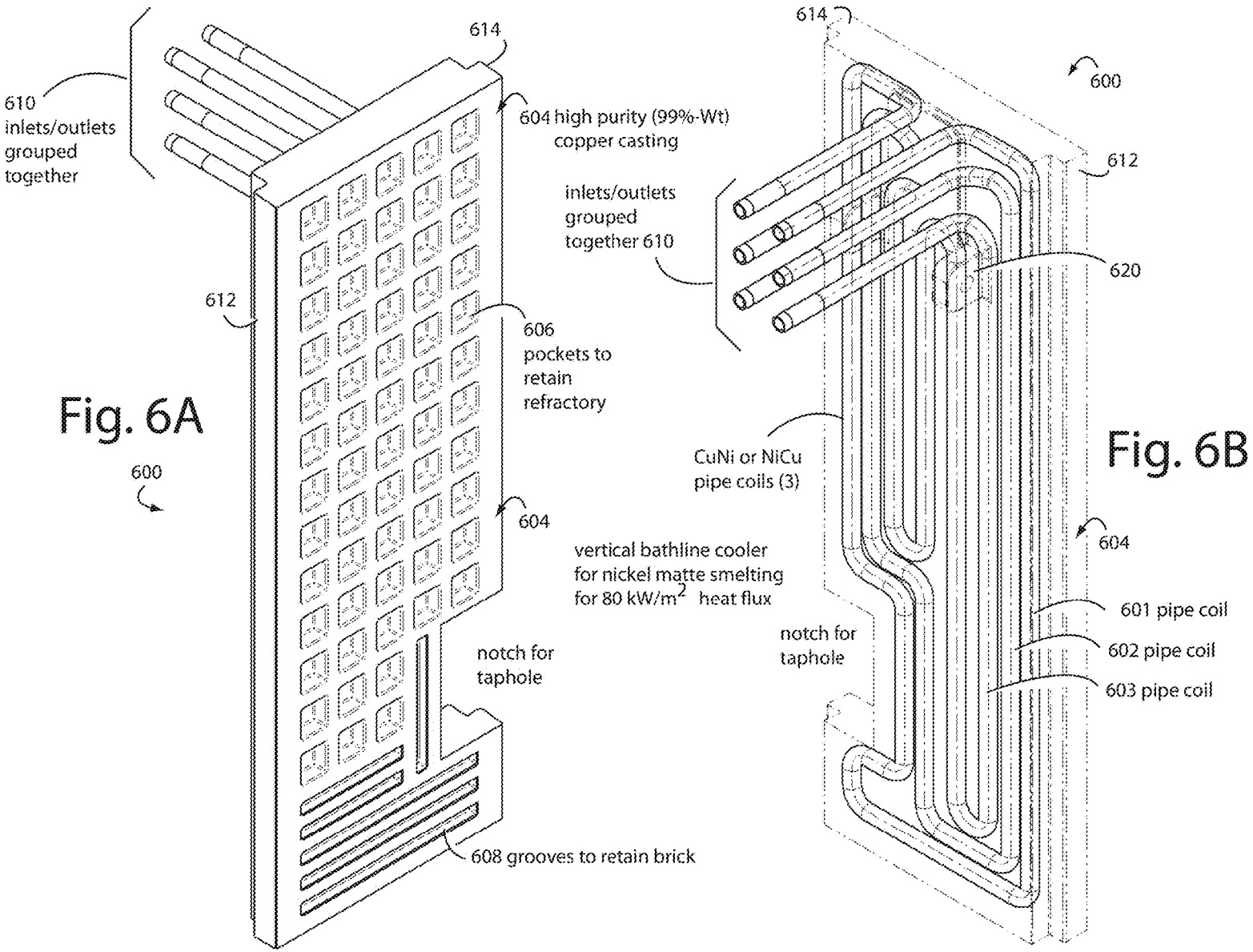
FIGS. 6A and 6B are front and back perspective view diagrams of a vertical bathline cooler for non-ferrous matte smelting that operates at an average heat flux of 80 $kW/m^2$.
Figures 8A, 8B, 8C, 8D:
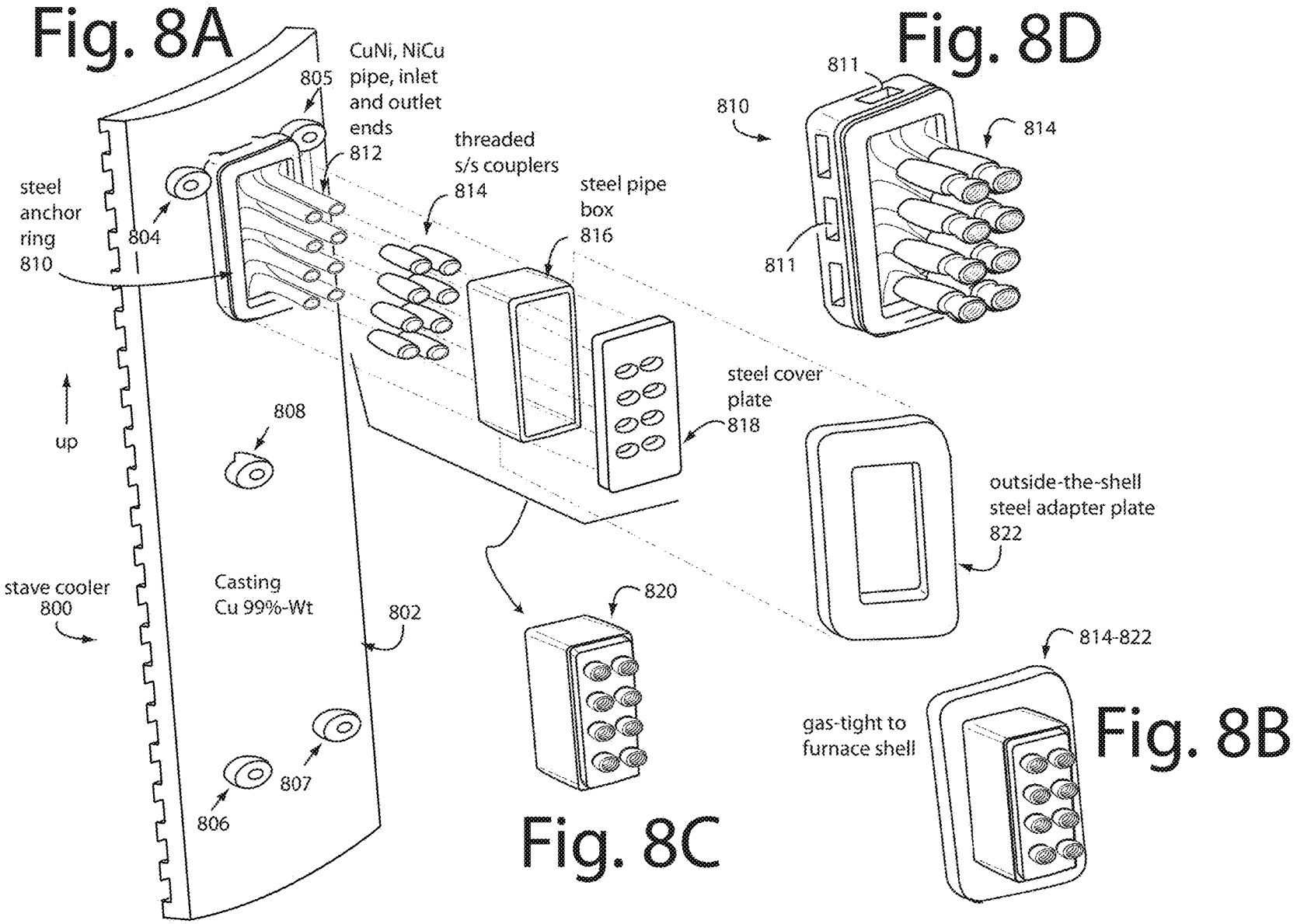
FIGS. 8A-8D are perspective view diagrams of a representation high heat flux copper stave cooler embodiment of the present invention that can be installed as is shown in FIGS. 7A-7J. The horizontal grooves shown can be profiled with dovetails to retain shotcrete, with inverted bell-curves or tulip contours to accept non-rotating bricks with matching contours, and the rotate-in-to lock contours represented in FIGS. 1, 2A, 2B, 3A, 3B, 4A-4D, and 5A-5E.

FIGS. 6A and 6B represent a vertical bathline cooler 600 for nickel non-ferrous smelting designed to operate at an average heat flux of 80 kW/m2. The vertical bathline cooler 600 comprises three CuNi or NiCu pipe coils 601-603 cast side-by-side inside a high purity copper casting 604. A hot face includes pockets 606 and grooves 608 to retain castable refractory and/or bricks.

Heat loads tend to vary from top to bottom much more than around a furnace, except at tap-hole, burners, electrodes, or other process related situations. For a blast furnace, it is highly advantageous to have the cooling pipes run vertically in order to minimize distortion of the metal cooler. If pipes are run horizontally, there is a greater tendency for the stave to bend mover in a vertical direction, which can lead to excessive permanent distortion. Due to the low creep strength of copper, the cooler must be designed to run at as uniform a temperature as possible, and not have hot bands of metal which will lead to increased plastic deformation. A stress analysis with an evaluation of creep is required for proper stave design.

Pockets 606 are typically filled with either castable, rammed refractory, or a blown-in lining. Bricks stacked in wall linings can be set in front of such cooling blocks. The retention of castable and blown in linings can be assisted with threaded anchors screwed into the hot face.

The pipe inlets/outlets are gathered together into a group 610. The casting 604 include overlap edges 612 and 614 that match with neighboring vertical bathline coolers with underlapping edges. Such a vertical bathline cooler 600 would benefit from casting and manufacturing, and CFD/FEA computer modelling techniques offered by the present inventor, Allan J. MacRae, in U.S. patent application Ser. No. 16/422,909, filed May 24, 2019.

The vertical bathline cooler 600 of FIGS. 6A and 6B is large and very heavy. Some means must be attached or included to be able to lift and manipulate these and copper stave coolers 200, 316, and 330 in FIGS. 2A, 2B, 3A, and 3B. FIG. 6B shows that there are two lug ears 620 included in the casting of vertical bathline cooler 600 suitable for lifting with an overhead chain hoist.

FIGS. 7A-7J show a more involved method 700 that allows copper stave coolers 200, 316, and 330 in FIGS. 2A, 2B, 3A, and 3B to be lifted, lowered through an opening in a blast furnace, and then have its steel pipe collection box or collar drawn into a mounting hole cut for it in a steel containment shell. The steel pipe collection box or collar is then welded in place.

During an installation phase, represented in FIGS. 7A-7D, method 700 employs a lifting device 702 with a key 703 that temporarily bolts onto the hot face. Key 703 grips under a horizontal hot face rib into a dovetail keyway. This keeps much of the load of lifting off temporary lifting bolts 704 and 706. Pipe couplings are temporarily screwed in the box cover to stand off a washer and a nut from the pipe coil inlet/outlet ends. Once the lifting device 702 is secured in place, while the stave cooler is on the ground, a hoist is positioned above. A hoist with a hook is lowered down and attached to a hoist ring.

The stave cooler is lifted up over an opening in the furnace, and then lowered down inside. A trolley on a rail can also be used to position a stave in its correct radial position. A draw line from outside the containment shell can be passed in through a hole cut in the containment shell for the stave's pipe box. The draw line is connected to bolts 704 and 706 with tabs. Then pulled in towards the shell. The steel pipe collection box or collar is then welded in place. After the welding is complete, the lifting equipment and devices can be removed, starting with the nuts and washers in bolts 704 and 706. The bolts 704 and 706 are free to be knocked inside with a punch and hammer.

The holes that were occupied by bolts 704 and 706 must be filled. They are drilled out and fitted with a copper/stainless plug rod of FIG. 7J. A rod of copper is solid-state welded to a rod of stainless steel. For example, by friction welding which produces coalescence at temperatures essentially below the melting point of the base materials being joined, without the addition of brazing or filler metal. These are inserted copper end first from outside the shell and the steel end is welded or bolted to the steel box cover.

FIGS. 8A-8D represent a high heat flux stave cooler 800 intended to operate inside a pyrometallurgical furnace at 25 $kW/m^2$ or higher. Its construction and installation is very similar to that of FIGS. 7A-7J and stave coolers 200, 316, and 330. Stave cooler 800 is a casting 802 of high purity copper (99%-Wt) with four CuNi or NiCu alloy pipe coils embedded within. There are four threaded bosses 804-807 and one or more wear monitor/thermocouple boss 808 cast in the copper. The four threaded bosses 804-807, or extra threaded holes on top can be used in lifting the stave for installation. The four threaded bosses 804-807 are ultimately for slip bolting the stave inside the containment shell in a way to prevent warping.

Thermocouples, wear monitors, and other monitoring devices are sometimes mounted between staves. Some staves have side notches for this purpose. In such case, casting boss 808 into the copper would be unnecessary.

A steel anchor ring 810 is cast inside copper casting 802 and surrounds four inlet and four outlet ends 812 from the four CuNi or NiCu alloy pipe coils embedded within. Each of these receives a stainless steel threaded coupler 814. A steel pipe box 816 is welded to the steel anchor ring 810 and must make a gas tight connection.

The entire operational weight of copper stave cooler 800 hangs from steel pipe box 816. A steel cover plate 818 is welded to the distal end of steel pipe box 816 and all around every stainless steel threaded coupler 814. This must complete a gas tight compartmentalization of process gasses inside and allow no escape. The assembly 820 represents the appearance after welding. Assembly 820 mounts in a hole cut for it in a steel containment shell. It is welded in place outside the shell with the aid of a steel adapter plate 822.

The characterizing result is external coolant connections are made accessible and process gases are sealed up inside.

Figure 9:
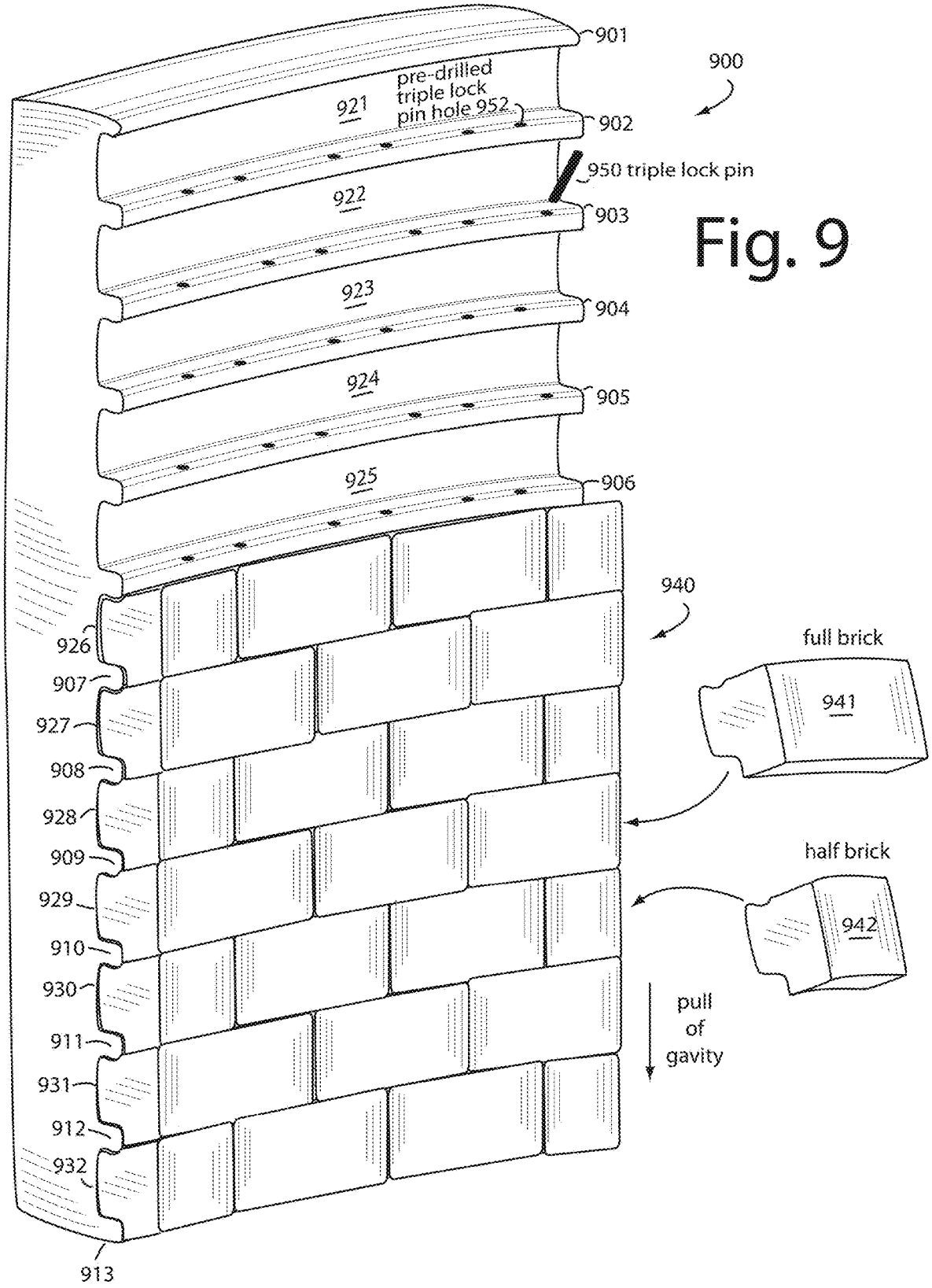
FIG. 9 is a perspective view diagram of a stave cooler showing how the bricks of FIGS. 1, 2A, 2B, 3A, 3B, 4A-4D, and 5A-5E should be installed such that the horizontal rows stagger but all rows on left and right end with the edge of the stave cooler. A combination of partial width bricks and full bricks are used to do this. A triple-lock pin like that of FIGS. 4A-4D is shown as are several pre-drilled holes for the pins in the ribs.

FIG. 9 represents a stave cooler 900 showing how the bricks of FIGS. 1, 2A, 2B, 3A, 3B, 4A-4D, and 5A-5E should be installed on the hot face between horizontal ribs 901-913 and into channels 921-932. A wall of brick 940 is installed using full bricks 941 and partial width bricks 942 such that the horizontal rows stagger, and all rows slightly overhang the edges on left and right of stave cooler 900. A triple-lock pin 950, like that of FIGS. 4A-4D is shown, as are several anchor holes 952 that are pre-drilled in ribs 901-913 for the pins.

Grooves with a reverse taper resembling a cabinetmaker's dovetail have been used for many years, either to hold frozen accretions or refractory. A layer of refractory or frozen accretions helps to protect the hot face of the copper from abrasion, corrosion, and oxidation. For blast furnaces, the back or cold face of the groove had rather sharp corners to match brick shapes which were slid in from on end. Unfortunately, the sharp corners lead to high stress areas in the copper and can lead to cracking. On the hot face, sharp corners tend to wear off, lead to high contact stresses with inserted brick and cause premature fracture, or if there is frozen material then sharp corners lead to high stresses causing the accretion to fall off. Sudden loss of refractory or accretions leads to large temperature spikes and transient stresses in the copper.

Figure 10:
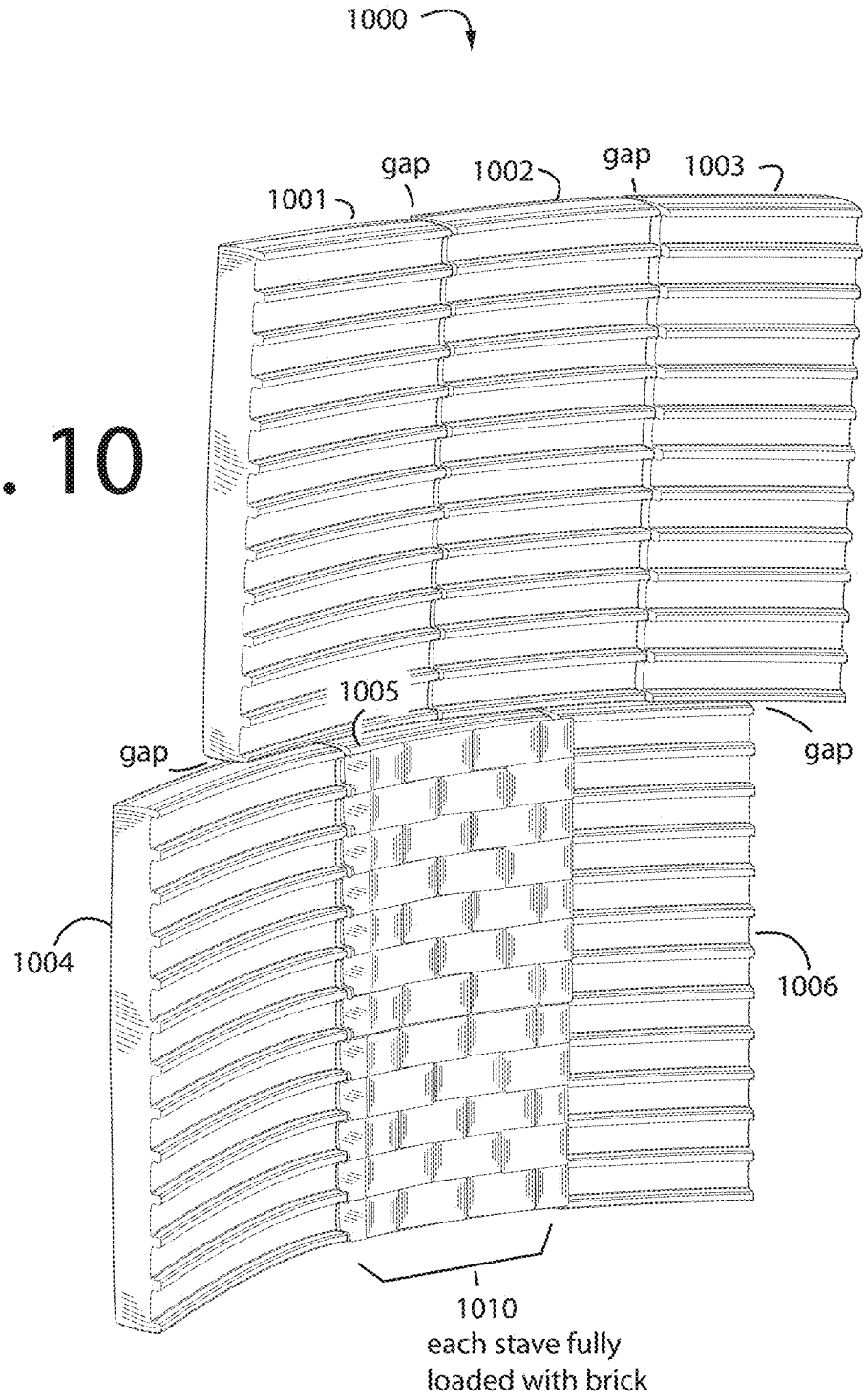
FIG. 10 is a perspective view diagram of several copper stave coolers as they might be arranged in two horizontal rows inside a circular furnace. Each copper stave cooler mounts to the furnace containment shell with a single steel collar high in the middle of each stave.

FIG. 10 represents several, laterally curved copper stave coolers 1001-1006 as they might be arranged in two horizontal rows inside a circular furnace 1000. A complement of bricks 1010 is carried by each copper stave cooler 1001-1006.

Each copper stave cooler mounts to a furnace containment shell with a single steel collar high in the middle of each stave. As each copper stave cooler 1001-1006 heats, the tops, bottoms and side edges will expand away from the respective mounting points. That means adjacent tops, sides, and bottoms will all close in on a gap between them. So it is important to have an adequate gap to accommodate this, and a crushable or deformable material that can absorb the deformations.

Each of the laterally curved copper stave coolers 1001-1006 will heat more on its front face than its rear face. Than tends to draw the outside perimeters of each stave cooler down closer to the containment shell. Albeit unevenly. This then presents a challenge to keep the gaps closed.

Each of the appended Claims following is understood to be incorporated herein by reference as if fully described in this detailed description of the embodiments.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A refractory brick to form a crucible lining in a pyrometallurgical furnace, comprising:

a brick principally comprising a refractory material and three-dimensionally formed to have:

a flat top comprising a means for contact with a portion of a bottom surface of a horizontal ring row of substantially identical bricks placed immediately above it in a pyro-metallurgical furnace, a flat back comprising a means for contact with a laterally curved copper stave cooler, a flat front comprising a means for receiving a heat flux through an included hot face in the pyro-metallurgical furnace parallel to the back, a pair of opposite flat/parallel vertical sides together comprising a means for contact shoulder-to-shoulder with any other bricks in a same horizontal ring row of substantially identical bricks in the pyro-metallurgical furnace, and a flat bottom parallel to the top and comprising a means for contact with a portion of a top surface of a horizontal ring row of substantially identical bricks placed immediately below it in the pyro-metallurgical furnace;

wherein, the brick is configured to fit as one member in any of the horizontal ring rows and that together form a crucible lining in the pyrometallurgical furnace;

wherein, each horizontal ring row of bricks is advantageously and immediately encircled by a matching plurality of laterally curved copper stave coolers, such that a relative difference in the coefficients of thermal expansion of the bricks versus the stave coolers directs the flat/parallel backs of the bricks to press harder in and thereby increase contact with each laterally curved copper stave coolers during operational heating;

a pre-drilled hole down from the flat top of the brick that provides access to receive and set a triple-locking metal pin into a corresponding stave rib.

2. The refractory brick of claim 1, further comprising:

a crushable or deformable mortar or adhesive placed in contact with the flat back of the brick;

wherein any contact is improved thereby and the brick is mechanically stabilized.

3. The refractory brick of claim 1, wherein:

the brick comprises means to be three-dimensionally formed such that the brick can maintain contact inside horizontal channels positioned in between pairs of evenly spaced horizontal ribs on a hot face surface of a corresponding laterally curved copper stave cooler;

wherein, each brick further comprises means for being three-dimensionally formed to fit and to be self retained between respective adjacent upper and lower pairs of the ribs by tilting in the top surface of the brick and tucking it in to lock under an upper of the ribs, and then rotating the bottom surface down with a favorably oriented pull of earth's gravity and inward to nest its back surface into the channels;

wherein, the brick includes means for employing the pull of earth's gravity to assist in retaining the brick in a corresponding laterally curved copper stave cooler after installation.

4. The refractory brick of claim 3, further comprising:

a metal pin disposed inside a pre-drilled hole in the brick, and that functions to triple-lock the brick to one of the horizontal ribs after installation.

5. The refractory brick of claim 1, wherein:

the materials used for and the three-dimensional shape of the brick are limited by a means for computational fluid dynamics (CFD) and/or finite element analysis (FEA) computer modeling in iterative steps of trial-and-error selections for the materials used for and the three dimensional shape of the brick with a given required campaign life and a predicted operational heat flux in excess of 25 $kW/m^2$.

6. The refractory brick of claim 5, wherein:

the materials used for the three-dimensionally shaped brick are pre-constrained in a set of boundary conditions to one of silicon carbide, carbon, high alumina, and graphite.

7. The refractory brick of claim 6, wherein:

the three-dimensional shape of the brick is further pre-constrained in its boundary conditions to provide an installed thermal expansion allowance gap to any adjacent bricks.

8. The refractory brick of claim 1, wherein:

the pre-drilled hole is aligned with a blind hole that was pre-drilled into a rib of a matching stave cooler into which the metal pin is pushed in and bottomed during installation;

wherein, each brick so equipped is further resistant to substantial spalling and exposure of the matching stave cooler during operation.

* * * * *